United States Patent [19]

Schlegel et al.

[11] Patent Number: 4,566,680

[45] Date of Patent: Jan. 28, 1986

[54] VERTICALLY ADJUSTABLE DEVICE

[75] Inventors: Wolfgang Schlegel, Oehringen; Arthur Wilke, Bad Friedrichshall-Jagstfeld; Roland Stein, Oehringen, all of Fed. Rep. of Germany

[73] Assignee: Schlegel G.m.b.H., Oehringen, Fed. Rep. of Germany

[21] Appl. No.: 483,537

[22] Filed: Apr. 11, 1983

[30] Foreign Application Priority Data

Apr. 23, 1982 [DE] Fed. Rep. of Germany ..... 3215217

[51] Int. Cl.[4] ..... B25B 1/00

[52] U.S. Cl. ..... 269/74; 269/78; 269/310

[58] Field of Search ..... 269/74, 77, 78, 81, 269/75, 310; 403/372; 384/125

[56] References Cited

U.S. PATENT DOCUMENTS 2,310,025 2/1943 Giern et al. ..... 269/75
2,798,748 7/1957 Maurer ..... 403/372
2,886,354 5/1959 Björklund ..... 403/372
4,247,156 1/1981 King ..... 384/125
4,387,886 6/1983 Schlegel et al. ..... 269/78 X

*Primary Examiner*—Frederick R. Schmidt
*Assistant Examiner*—Steven P. Schad
*Attorney, Agent, or Firm*—Daniel H. Kane, Jr.

[57] ABSTRACT

A vertically adjustable device for carrying a vise, an assembly platform or the like comprises a support tube which is vertically adjustably arranged within a guide tube arranged for attachment to a work bench or the like. In order to facilitate the vertical adjustment a gas spring is provided which acts between the support tube and the guide tube end exerts an upwardly directed force upon the support tube. The gas spring comprises a cylinder, a piston movable therein and a piston rod extending from the piston. The cylinder is arranged and held within the support tube so that upon removal of the support tube and the implement carried thereby by pulling the support tube out of the guide tube the gas spring is simultaneously removed leaving the work bench clear for other work.

9 Claims, 10 Drawing Figures

VERTICALLY ADJUSTABLE DEVICE

FIELD OF THE INVENTION

This invention relates to a novel vertically adjustable device for vises, assembly platforms and the like. Such devices are useful for bringing the vise or the like into an optimum vertical position with respect to the worker in order to facilitate the working of a workpiece or the assembly of an apparatus.

BACKGROUND OF THE INVENTION

Such devices comprise a vertical cylindrical tube supporting at its upper end the vise or the assembly platform and being guided for vertical movement within a guide tube. At its upper end the guide tube is axially slotted and can be clamped together to hold the support tube and therewith the vise or assembly platform in any desired vertical position. To this end a clamping device is provided which embraces the upper end of the guide tube and which can be connected to a work bench or the like. Normally the clamping device comprises two half-cylindrical shells which surround the upper end of the guide tube and which can be clamped together in order to decrease the diameter of said end. In order to facilitate the vertical adjustment a gas spring is provided which comprises a piston and cylinder unit and is arranged between the guide tube and the support tube and exerts an upwardly directed force on the support tube. In known devices of this kind the cylinder of the gas spring is arranged within and connected to the guide tube whereas the piston rod extending from the cylinder abuts the platform at the upper end of the support tube. Such device is f.i. disclosed in patent application Ser. No. 436,282.

Now it is often desirable to remove the vise or assembly platform from the work bench in order to have the work bench clear for other work. For this purpose one could screw the clamping device off the work bench which, however, is troublesome if the clamping device is connected by ordinary screws and not by an attachment screw. The other possibility is to loosen the clamping device so that the support tube with the vise can be pulled out of the guide tube. In this case, however, the piston rod still projects from the guide tube and disturbs working on the work bench.

OBJECT OF THE INVENTION

It is therefore the primary object of the invention to provide a vertically adjustable device of the kind set forth which allows removal of the vise, the assembly platform or the like without leaving interfering elements.

DISCLOSURE OF THE INVENTION

According to the invention this object is met by arranging the cylinder of the gas spring within the support tube and abutting the piston rod at the guide tube so that, when the support tube is pulled out of the guide tube after loosening the clamping device the gas spring is also removed leaving at the work bench only the clamping device with the guide tube projecting downwardly therefrom so that any hindrance to working on the work bench is neglegible.

The support of the cylinder of the gas spring within the support tube can be positive f.i. by screwing the cylinder to the support tube. To this end the bottom of the cylinder can be provided with a projecting screw bolt which is screwed into a tap hole provided in an end plate of the support tube which plate can be used to support the vise or form an assembly platform. Alternatively a non-positive connection between the cylinder and the support tube can be provided, f.i. by means of at least one disk the inner periphery cooperating with the outer surface of the cylinder and the outer periphery cooperating with the inner surface of the support tube. To obtain a self-clamping effect the disk can be dish-shaped or provided at its inner and outer periphery with toothing and can be annular or star-shaped or triangular. The inner and outer periphery of the disk need not be exactly co-axial because normally there is no need that the gas spring is exactly centered within the support tube. Usually at least two disks are provided in spaced relationship. If in this case at least one disk with non-coaxial inner and outer periphery is used an inclined position of the gas spring within the support tube can be obtained which position eases the vertical adjustment as described in U.S. Pat. No. 4,387,886. In other words, the inner periphery is off center from the axis of the outer periphery so that the gas spring may be supported in an inclined position relative to the axis of the support tube.

The non-positive support of the cylinder of the gas spring within the support tube can also be obtained by at least one tubular, one- or multipiece filling element which is arranged between the cylinder and the support tube. The filling element can consist of an elastic material, f.i. foam material. The filling element can have the shape of a cone with a conically inwardly extending portion at its end with the smaller diameter, the inner and outer edges being provided with incisions or indentations which hook with the outer surface of the cylinder and the inner surface of the support tube, respectively.

As a final alternative the cylinder of the gas spring can be formed by the support tube itself.

BRIEF DESCRIPTION OF THE DRAWINGS

A preferred example embodiment of the invention and some modifications thereof are shown in the accompanying drawings.

Figure 1:
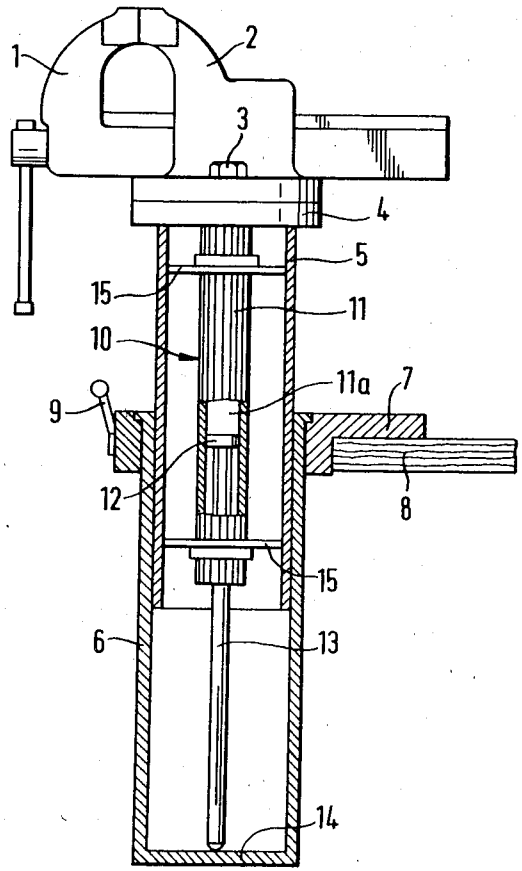
FIG. 1 is a side elevation, partly in section, of a device according to the invention carrying a vise.

The vertically adjustable vise shown in FIG. 1 comprises a movable jaw 1 and a stationary jaw 2. Jaw 2 is attached to a support plate 4 by means of screws 3. Support plate 4 is connected to a support tube 5 extending downwardly thereof. Support tube 5 is vertically and rotatably adjustably arranged within a guide tube 6 which is connected to a work bench 8 by means of a mounting 7 and extends downwardly thereof. The upper end of guide tube 6 is provided with longitudinal slots (not shown) and the mounting 7 comprises two half-cylindrical shells (not shown) which can be clamped together by actuation of a hand lever 9. If the shells are loosened the support tube 5 and the vise can be lifted or lowered to the desired position and can be clamped in place by tightening hand lever 9. To support the lifting of the support tube 5 with the vise and eventually with a work piece clamped in the vise a gas spring 10 is provided between the support tube 5 and the guide tube 6. Said gas spring 10 comprises a cylinder 11 and a piston 12 from which a piston rod 13 extends. Cylinder 11 abuts with its upper end on the lower surface of support plate 4, and piston rod 13 abuts on the closed lower end 14 of guide tube 6. The cylinder space 11*a* upwardly of piston 12 is filled with pressurized fluid which assists the upward movement of the support tube 5 and the elements carried by it.

As can be seen from FIG. 1, the cylinder 11 of the gas spring 10 is arranged and supported within support tube 5 so that it is possible to pull the support tube 5 together with the gas spring 10 out of the guide tube 6 when the hand lever 9 is loosened. On the work bench 8 there remains then only the mounting 7 and the guide tube 6 extending downwardly therefrom so that working on the work bench 8 is not impeded.

The support of the cylinder 11 within the support tube 5 can be effected in a number of different ways including both positive and non-positive engagement. In the preferred embodiment of FIG. 1 there are provided two spaced disks 15 which are shown in plan view in FIG. 2. These disks 15 are star-shaped and are with their outer periphery 16 in non-positive engagement with the inner wall of support tube 5 and with their inner periphery 17 in non-positive engagement with the outer surface of cylinder 11. The disks 15 are somewhat flexible and can be of metal or plastics. In assembling gas spring 11 and support tube 5 the disks 15 are slipped by force upon the cylinder 11 and then the cylinder is inserted into support tube 5 whereby the disks 15 are slightly flexed and clamp themselves on the wall of support tube 5. Thus, "non-positive engagement" is intended to means this movable frictional engagement, clamping or abutting of the disk against the walls of the support tube 5 and cylinder 11 in contrast to a positive, permanent, fixed or stationary fastening. Thus, the position of the disks 15 may be altered and the disks may be slipped, inserted or moved by force.

Figure 2:
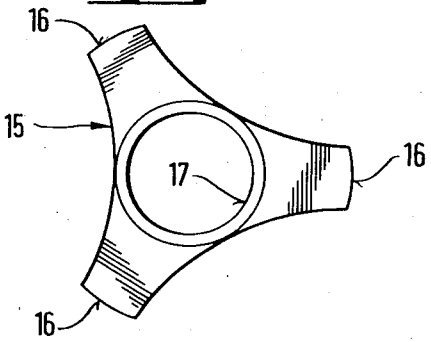
FIG. 2 is a plan view of a star-shaped disk used in FIG. 1 for holding the cylinder of the gas spring within the support tube.
Figure 2A:
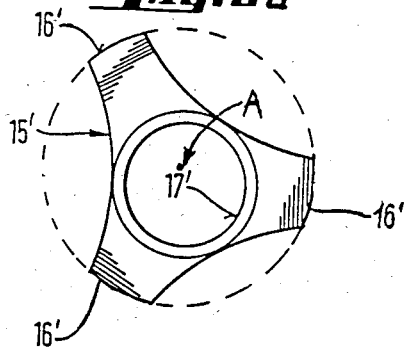

One of the two spaced disks alternatively may be a disk 15' as illustrated in FIG. 2A in which the inner periphery 17' is off-center from the axis A of the outer periphery 16' of the disk 15' so that the cylinder 11 of gas spring 10 is supported in an inclined position relative to the axis of the support tube 5.

Figure 3:
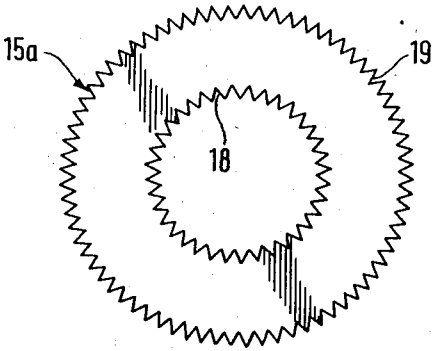
FIGS. 3, 4 and 5 are plan views of modified disks which can be used in lieu of the disk of FIG. 2.

The disk 15*a* of FIG. 3 which can be used in lieu of disk 15 of FIG. 2 is provided at its inner and outer periphery with a toothing 18 and 19, resp., which hook with the outer surface of cylinder 11 and the inner wall of support tube 5, respectively.

Figure 4:
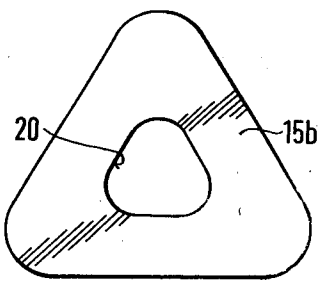

Alternatively, as shown in FIG. 4, the disk 15*b* can be triangular with rounded corners, and also the opening 20 for accommodating the cylinder 11 is triangular. The outer diameter and the inner diameter of disk 15*b* are selected in such way that desired non-positive engagement with the inner wall of the supporting tube 5 and the outer surface of cylinder 11 is obtained.

Figure 5:
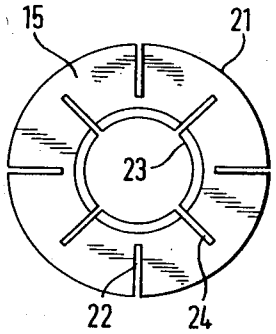
Figure 6:
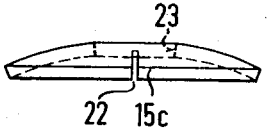
FIG. 6 is a side elevation of the disk of FIG. 5.

FIGS. 5 and 6 show an annular disk 15*c* which has slots 22 extending from its outer periphery 21 inwardly and slots 24 extending from its inner periphery outwardly. the slots 22 and 24 are staggered with respect to each other. As can be seen from FIG. 6 the disk 15*c* is dish-shaped so that it clamps itself in place when introduced into the support tube 5 together with the cylinder 11 and opposes any withdrawal from the support tube 5

Figure 7:
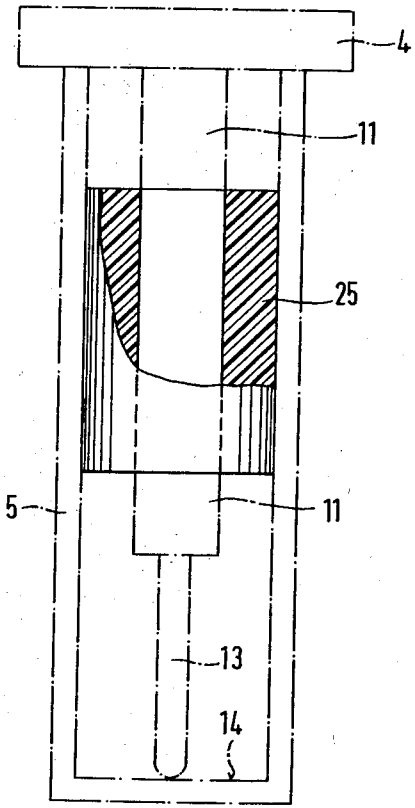
FIG. 7 is a side elevation, partly in section, of a filling element arranged between the cylinder and the support tube shown in phantom lines.

In the embodiment of FIG. 7 there is provided an insert 25 between the support tube 5 and the cylinder 11. This insert can be one- or multi-piece and is preferably of an elastic material such as foam rubber as it need not take up substantial forces but has only the task to keep the cylinder 11 in place within the support tube 5. It could also be made of a metal preferably a light alloy. In any case it is held by friction on the cylinder 11 and on the inner wall of support tube 5.

Figure 8:
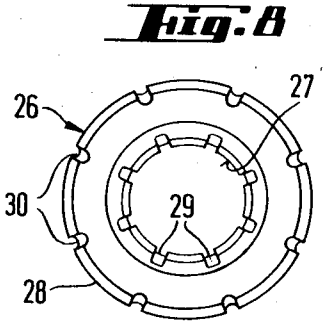
FIG. 8 is a plan view from bottom of a clamping element for arrangement between the cylinder and the support tube.
Figure 9:
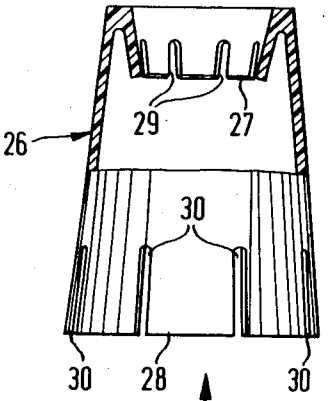
FIG. 9 is a side elevation, partly in section, of the clamping element of FIG. 8.

FIGS. 8 and 9 show an insert 26 which is designed to be arranged between the cylinder 11 and the support tube 5 the same way as insert 25 of FIG. 7. Insert 26 has a frusto-conical shape and the edge at its smaller diameter is projecting inwardly and has an inverted frustroconical shape. Inner edge 27 and outer edge 28 are provided with incisions 29 and 30, respectively, in order to assist the clamping of these edges on the outer surface of the cylinder 11 and the inner wall of support tube 5. Insert 26 can be made of a relatively rigid plastics or of metal.

Figure 10:
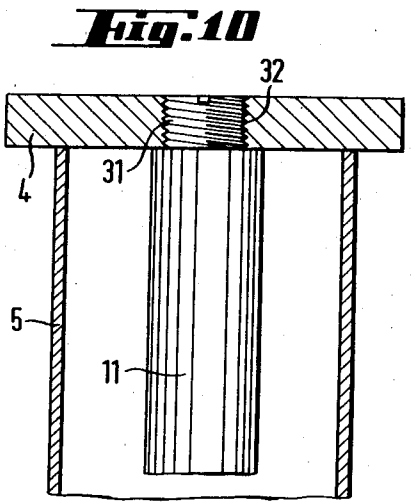
FIG. 10 is a side elevation, partly in section, of the upper end of the support tube and the cylinder with a positive scrwe connection between these parts.

A positive connection of cylinder 11 in support tube 5 is shown in FIG. 10. A threaded bolt 31 extends from the closed end of cylinder 11 and is screwed into a tap hole 32 in the support plate 4 at the upper end of support tube 5.

Naturally many modifications of the examples shown in the drawings are possible within the scope of the invention. So the object of the invention could also be met in that the support tube 5 forms itself the cylinder of the gas spring.

We claim:

1. A vertically adjustable device comprising a vertical support tube for carrying a vise or assembly platform, a mounting for attachment of the support tube to a work bench or support, said mounting comprising a guide tube accommodating the support tube for vertical adjustment and a clamping device for clamping the support tube in place in any vertical position, and further comprising a gas spring comprising a cylinder and a piston movable therein and a piston rod extending from the piston, said gas spring being arranged between said support tube and said guide tube to exert an upwardly directed force on the support tube, wherein the cylinder of the gas spring is arranged within the support tube and held therein by at least one disk having an inner and an outer periphery between the cylinder and the support tube, said inner periphery being in frictional engagement with the outer surface of the cylinder and said outer periphery being in frictional engagement with the inner wall of the support tube, and the piston rod removably abuts against the guide tube so that the gas spring is withdrawn simultaneously with support tube when the support tube is removed from the guide tube thereby leaving the workbench or support clear for other work without interference by the gas spring.

2. The invention as claimed in claim 1 wherein said disk is dish-shaped.

3. The invention of claim 1 wherein the disk is provided with toothing at its inner and outer periphery.

4. The invention as claimed in claim 1 wherein the disk is star-shaped.

5. The invention as claimed in claim 1 wherein the disk is triangular.

6. The invention as claimed in claim 1 wherein the outer periphery is off center from the axis of the outer periphery of the disk.

7. The invention of claim 1 wherein at least two disks are arranged in spaced relationship between the cylinder of the gas spring and the support tube, at least one of said disks having an inner periphery off center from the outer periphery.

8. The invention of claim 1 wherein said disk is of a flexible material.

9. A vertically adjustable device comprising a vertical support tube for carrying a vise or assembly platform, a mounting for attachment of the support tube on a work bench or support, said mounting comprising a guide tube accommodating the support tube for vertical adjustment and a clamping device for clamping the support tube in place in any vertical position, and further comprising a gas spring having a cylinder, a piston movable therein and a piston rod extending from the piston, said gas spring being arranged between the guide tube and the support tube to exert an upwardly directed force upon the latter, wherein the gas spring cylinder is arranged within the support tube and held therein by means of at least two annular disks arranged in spaced relationship upon the cylinder, said disks each having an outer and an inner periphery, the outer periphery abutting in frictional contact with the outer surface of said cylinder, and the piston rod removeably abutting against the guide tube so that the gas spring cylinder and piston are withdrawn with the support tube when the support tube is removed from the guide tube thereby leaving the workbench clear for other work without obstruction by the gas spring.

* * * * *

UNITED STATES PATENT AND TRADEMARK OFFICE

CERTIFICATE OF CORRECTION

PATENT NO. : 4,566,680

DATED : January 28, 1986

INVENTOR(S) : Wolfgang Schlegel et al.

It is certified that error appears in the above-identified patent and that said Letters Patent is hereby corrected as shown below:

Column 6, line 13, after "frictional contact" insert:

--with the inner wall of the support tube and the inner periphery abutting in frictional contact--.

Signed and Sealed this

*Nineteenth* Day of *August 1986*

[SEAL]

*Attest:*

DONALD J. QUIGG

*Attesting Officer*

*Commissioner of Patents and Trademarks*